US009909236B2

(12) United States Patent
Kuhn et al.

(10) Patent No.: US 9,909,236 B2
(45) Date of Patent: Mar. 6, 2018

(54) CROSS-LAPPER

(71) Applicant: HI TECH TEXTILE HOLDING GMBH, Leonding (AT)

(72) Inventors: Rudolf Kuhn, Neusäss (DE); Steffen Hartung, Kissing (DE); Andreas Meier, Affing (DE); Joachim Binnig, Jettingen-Scheppach (DE); Eberhard Häberle, Wildberg (DE)

(73) Assignee: HI TECH TEXTILE HOLDING GMBH, Leonding (AT)

( * ) Notice: Subject to any disclaimer, the term of this patent is extended or adjusted under 35 U.S.C. 154(b) by 453 days.

(21) Appl. No.: 14/414,247

(22) PCT Filed: Jul. 12, 2013

(86) PCT No.: PCT/EP2013/064781
§ 371 (c)(1),
(2) Date: Jan. 12, 2015

(87) PCT Pub. No.: WO2014/009520
PCT Pub. Date: Jan. 16, 2014

(65) Prior Publication Data

US 2015/0176159 A1 Jun. 25, 2015

(30) Foreign Application Priority Data

Jul. 13, 2012 (DE) ..... 20 2012 102 597 U

(51) Int. Cl.
*D01G 25/00* (2006.01)
*D04H 1/736* (2012.01)

(52) U.S. Cl.
CPC ..... *D01G 25/00* (2013.01); *D04H 1/736* (2013.01)

(58) Field of Classification Search
CPC ..... D01G 25/00; D04H 1/736
USPC ..... 19/163, 161.1
See application file for complete search history.

(56) References Cited

U.S. PATENT DOCUMENTS 3,232,297 A * 2/1966 Gamberini ..... A24C 5/396 131/109.2
3,737,051 A * 6/1973 Horino ..... B65H 31/38 414/788
3,877,628 A * 4/1975 Asselin ..... D01G 25/00 19/163

(Continued)

FOREIGN PATENT DOCUMENTS

DE 295 18 587 U1 4/1997
DE 203 21 834 U1 8/2011

(Continued)

*Primary Examiner* — Shaun R Hurley
*Assistant Examiner* — Bao-Thieu L Nguyen
(74) *Attorney, Agent, or Firm* — McGlew and Tuttle, P.C.

(57) ABSTRACT

A cross-lapper (1) includes an upper carriage (2), a laying carriage (3), and two endless laying belts, which are each guided on the main carriages (2, 3) by deflecting rollers (15 to 21). The one laying belt (6) is designed as a feeding belt, which carries a fibrous web (9) and feeds the fibrous web to the upper carriage (2). The other laying belt (7) is designed as a counter belt. The upper carriage (2) has a belt deflection device (12) for both laying belts (6, 7). At the belt deflection device (12), the laying belt (6) is deflected by approximately 180 degrees from a feeding direction (11) thereof to the opposite direction by means of three of more deflection points (15, 16, 17).

25 Claims, 2 Drawing Sheets

(56) References Cited

U.S. PATENT DOCUMENTS 4,144,808 A * 3/1979 Iwasa ..... B21C 51/005 101/41
4,192,232 A * 3/1980 Kato ..... G03G 15/325 101/489
4,357,739 A * 11/1982 Hille ..... D01G 25/00 19/163
4,830,351 A * 5/1989 Stanislaw ..... B65H 29/36 19/163
4,980,952 A * 1/1991 Erni ..... D01G 15/46 19/106 R
4,984,772 A * 1/1991 Freund ..... D04H 1/74 19/163
5,179,764 A * 1/1993 Iwade ..... D01H 5/64 19/245
5,285,554 A * 2/1994 Jean ..... D04H 1/74 19/163
5,289,617 A * 3/1994 Jean ..... D04H 1/74 19/163
5,341,543 A * 8/1994 Jean ..... D01G 25/00 19/161.1
5,373,610 A * 12/1994 Jean ..... D01G 25/00 19/163
5,400,475 A * 3/1995 Hille ..... D01G 25/00 19/163
5,450,516 A * 9/1995 Pasquali ..... B01D 63/02 385/115
5,590,442 A * 1/1997 Hirschek ..... D01G 25/00 19/163
RE35,982 E * 12/1998 Freund ..... D04H 1/74 19/163
6,085,391 A * 7/2000 Schaffler ..... D01G 25/00 19/161.1
6,195,844 B1 * 3/2001 Jourde ..... D01G 15/46 19/161.1
6,550,107 B1 * 4/2003 Jourde ..... D01G 25/00 19/161.1
6,658,221 B2 * 12/2003 Hama ..... G03G 15/5058 399/49
7,100,862 B2 * 9/2006 Skarzenski ..... B30B 9/3082 100/87
7,156,339 B2 * 1/2007 Nicolai ..... B65H 18/16 242/541.4
7,226,518 B2 * 6/2007 Loubinoux ..... D04H 3/004 156/148
7,480,965 B2 * 1/2009 Dilo ..... D01G 25/00 19/163
7,489,884 B2 * 2/2009 Ichikawa ..... G03G 15/5033 347/135
7,690,086 B2 * 4/2010 Dilo ..... D01G 25/00 19/163
7,779,513 B2 * 8/2010 Dilo ..... D01G 25/00 19/163
7,810,218 B2 * 10/2010 Dilo ..... D01G 25/00 19/163
7,850,825 B2 * 12/2010 Scherb ..... D21F 3/0272 162/358.1
7,895,715 B2 * 3/2011 Leger ..... D01G 25/00 19/296
7,928,025 B2 * 4/2011 Shipley ..... D04H 18/02 156/148
8,365,370 B2 * 2/2013 Leger ..... D01G 25/00 19/161.1
8,381,375 B2 * 2/2013 Dos Santos ..... D01G 23/06 19/163
8,464,400 B2 * 6/2013 Dilo ..... D01G 25/00 19/163
8,615,183 B2 * 12/2013 Nagasaki ..... G03G 15/6529 399/34
8,666,272 B2 * 3/2014 Kobayashi ..... G03G 15/2046 399/328
8,867,941 B2 * 10/2014 Takada ..... G03G 15/2028 399/329
9,020,383 B2 * 4/2015 Ishida ..... G03G 15/0131 399/395
2005/0193525 A1 9/2005 Leger
2006/0051151 A1 * 3/2006 Coenen ..... B41J 11/0075 400/613
2008/0038025 A1 * 2/2008 Zaretsky ..... G03G 15/162 399/308
2013/0198998 A1 * 8/2013 Kuhn ..... D01G 25/00 19/163

FOREIGN PATENT DOCUMENTS

EP 0 517 563 B2 12/1992
EP 0 522 893 A2 1/1993
EP 1 010 785 A2 6/2000
EP 1 010 786 A2 6/2000
EP 1 010 787 A2 6/2000
EP 1 136 600 A1 9/2001
EP 1 828 453 B1 6/2008
JP S56 026011 A 3/1981

* cited by examiner

CROSS-LAPPER

CROSS REFERENCE TO RELATED APPLICATIONS

This application is a United States National Phase Application of International Application PCT/EP2013/064781 filed Jul. 12, 2013 and claims the benefit of priority under 35 U.S.C. § 119 of German Patent Application DE 20 2012 102 597.3 filed Jul. 13, 2012, the entire contents of which are incorporated herein by reference.

FIELD OF THE INVENTION

The present invention pertains to a crosslapper with main carriages, especially an upper carriage and a laying carriage, as well as two endless laying belts, which are each guided via deflection rollers on the main carriages, whereby the one laying belt is designed as feeding belt, which carries a fibrous web and feeds to the upper carriage, and the upper carriage has a belt deflection device for both laying belts, whereby the laying belt is deflected at the belt deflection device from its direction of feed into the opposite direction by about 180° and pertains to a crosslapper method.

BACKGROUND OF THE INVENTION

Such a crosslapper is known from EP 1 828 453 B1. It is designed as a so-called belt crosslapper and has two main carriages (upper carriage and laying carriage) as well as two laying belts, which are guided via deflection rollers on the main carriages. The upper carriage has a belt deflection device for both laying belts. The one laying belt is designed as a feeding belt, on which a fibrous web is transferred on the input side of the crosslapper. The feeding belt with the fibrous web lying on it is deflected at the belt deflection device by 180° into the opposite direction via two rollers, whereby both laying belts have straight, parallel belt sections directed diagonally downward on the belt deflection device, between which the web is received and guided in clamping connection on both sides.

DE 295 18 587 U1 and EP 1 136 600 A1 also show crosslappers with such a belt deflection device on the upper carriage with two deflection points for the feeding belt with the web lying on it.

Another crosslapper with two main carriages and two laying belts as well as a belt deflection device on the upper carriage is known from EP 0 522 893 A2. The two laying belts are guided at the belt deflection device, with formation of an intake funnel, diagonally downward to a clamping point between two closely adjacent deflection rollers. The fibrous web, which is fed open at first to the feeding belt, is clamped on both sides at the clamping point and deflected there by more than 90°. Like the state of the art mentioned in the introduction, this belt deflection device has two deflection points with deflection rollers for each laying belt.

The prior-art crosslappers are limited in their capability, especially in the possible throughput speed of the web. This is especially the case in very light and sensitive fibrous webs.

SUMMARY OF THE INVENTION

An object of the present invention is to show an improved crosslapper technology.

According to the invention, a crosslapper is provided with main carriages, especially an upper carriage and a laying carriage, as well as two endless laying belts, which are each guided via deflection rollers on the main carriages. The one laying belt is designed as a feeding belt, which carries a fibrous web and feeds the web to the upper carriage. The upper carriage has a belt deflection device for both laying belts. The laying belt (feeding belt) is deflected at the belt deflection device from a direction of feed into an opposite direction by about 180°. The belt deflection device has three or more deflection points for the laying belt (feeding belt).

The crosslapper with the inventive belt deflection device and the crosslapper method have the advantage that the fibrous web can be guided in an improved and gentle manner and be transported via the belt deflection device. In addition, higher throughput speeds of the fibrous web than in the state of the art are possible.

An arrangement of first and second and possibly additional straight belt sections with a corresponding number of three or more deflection points at the belt deflection device has the advantage that the fibrous web can be guided better at the critical points. Compared with the state of the art, the three or more deflection points reduce the deflection angle, which is also advantageous for guiding and holding the web. The belt and web deflection can take place in a plurality of steps gradually and thus in a gentle manner. The last straight belt section at the end of the belt deflection device may already have a slope in the direction opposite the direction of feed, whereby in this belt section, the web can be guided by the laying belts on both sides in clamping connection. In this belt section, the web can be strengthened, such that it can pass the last deflection point reliably and even with higher throughput speed in spite of an only one-sided web guide there. Centrifugal-force-related separations of the fibrous web from a laying belt guiding only on one side or structural changes in the fibrous web at such deflection points can be avoided with the belt deflection device according to the present invention.

The claimed crosslapper can be designed for very high belt and web running speeds. A design as a synchronous crosslapper with main carriages moved in the same direction is advantageous for this. The web can be fed from the upper carriage, the laying carriage in a direct and straight path without further deflections and be laid by the laying carriage onto a pull-off device.

In addition, the crosslapper may have a tensioning device or belt length compensating device, which makes possible an uncoupling of the main carriages and their kinematics. As a result of this, the weight per unit area of the laid nonwoven can be affected and/or possibly changed via the laying width and/or via the nonwoven length. In addition, the crosslapper may have a buffer function for the compensation of fluctuating intake speeds of the fibrous web.

The present invention is shown in examples and schematically in the drawings. The present invention shall be explained in more detail on the basis of the following figures and exemplary embodiments, without the present invention being limited to these. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

The present invention pertains to a crosslapper (1) as well as a nonwoven laying method. The present invention also pertains to a fiber treatment plant with a crosslapper (1) and additional plant components.

Figure 1:
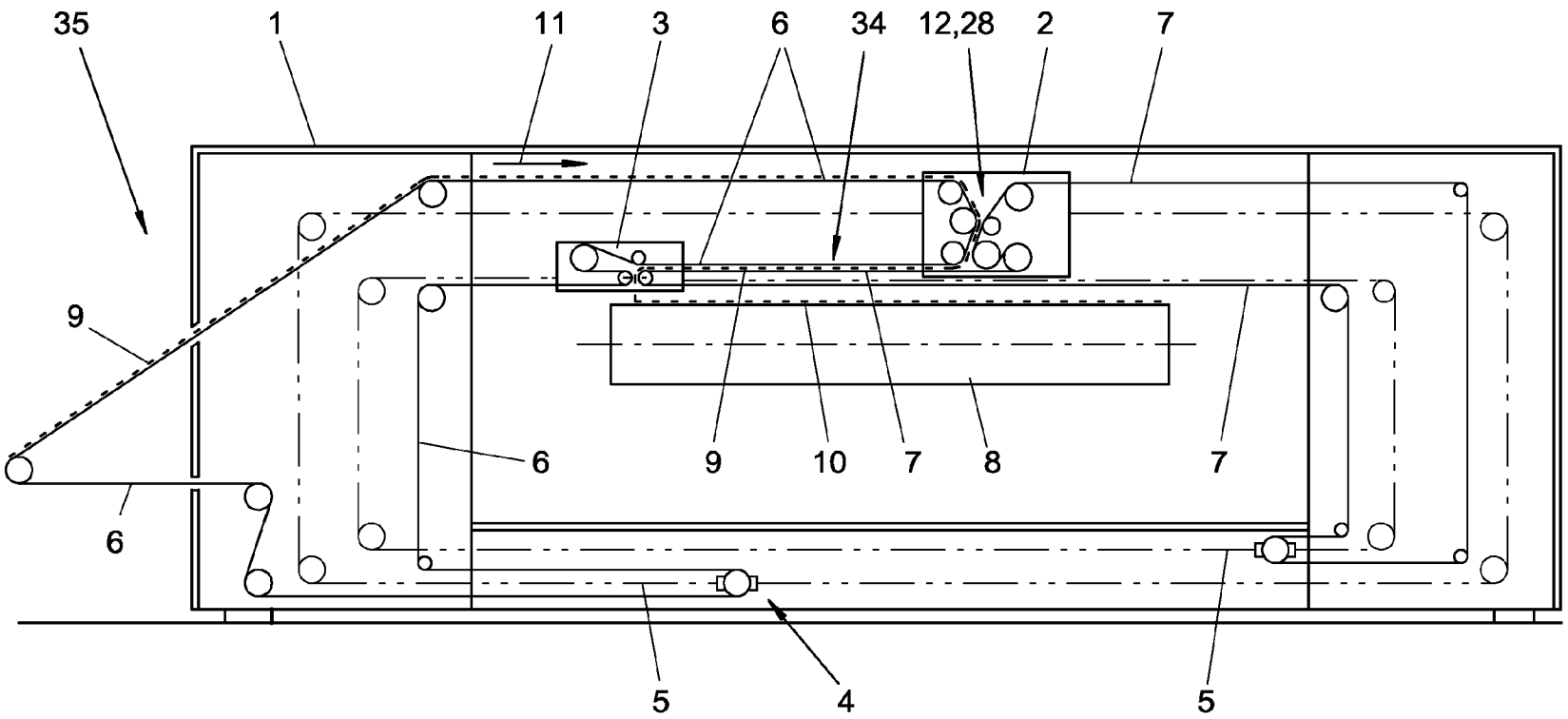
FIG. 1 is a schematic view of a crosslapper with two main carriages and a belt deflection device on the upper carriage.

The crosslapper (1) is used to plait down a fed fibrous web (9) into a multilayer nonwoven (10). In the exemplary embodiment of FIG. 1, the crosslapper (1) has, for this, two main carriages (2, 3), namely a first main carriage or upper carriage (2) and a second main carriage or laying carriage (3), and two laying belts (6, 7), which are endless and each guided in a loop via both main carriages (2, 3). Further, the crosslapper (1) has a pull-off device (8) directed transversely or diagonally to the path of motion of the main carriages (2, 3) for taking up and removing the multilayer nonwoven (10). In addition, the crosslapper (1) may have a tensioning device (4).

The two laying belts (6, 7), which are guided in separate loop paths, merge from different directions at the upper carriage (2), are guided there via a belt deflection device (12) described below and emerge in a parallel position at the upper carriage (2), whereby they take up the fibrous web (9) between them and guide it on both sides in clamping connection. In the exemplary embodiment of an equidirectional crosslapper (1) shown, the fibrous web (9) is transferred from this parallel belt section directly in a straight path to the laying carriage (3). At the laying carriage (3), the laying belts (6, 7) separate again and are guided away in opposite directions, whereby the released fibrous web (9) protrudes downwards to the pull-off device (8) and is laid there. For this, the laying carriage (7) performs reversing travel motions in transverse direction to the pull-off device (8), which performs a forward motion preferably coupled with the laying carriage motion and removes the nonwoven (10) plaited down in a flake-shaped pattern.

The main carriages (2, 3) are mounted and are guided movably in parallel to one another on a track guide in the frame of the crosslapper (1) by means of running gears (31). Here, they have each their own and independently controllable drive (not shown) for their travel motion. In the equidirectional crosslapper shown, the main carriages (2, 3) move in the same direction of travel, whereby the upper carriage (2) has twice the path and twice the speed compared with the laying carriage (3).

The travel motions of the main carriages (2, 3) may be uncoupled from one another, such that the loop length of the laying belts (6, 7), which are guided parallel between the main carriages (2, 3), can be changed due to differences in motion and a web storage unit can consequently be formed. The laying belts (6, 7) may also have independent drives, which they displace in a controlled rotary motion. Due to such a configuration, it is possible to influence the discharge speed of the fibrous web (9) at the laying carriage (3) and in particular to uncouple from the travel speed of the laying carriage (3). The deposit of the web on the pull-off device (8) and the weight per unit area of the nonwoven (10) can be hereby influenced and be changed via the laying width of the traveling to and fro laying carriage (3). Thus, edge thickenings of the nonwoven (10) can be avoided, on the one hand, and certain profilings in the transverse and/or longitudinal direction of the nonwoven (10) can be formed, on the other hand. With such profilings, the strengthened end product is able to obtain a desired weight per unit area distribution, or error compensation of web or strengthening errors can be conducted. In addition, it is possible to compensate speed fluctuations in the fed fibrous web (9) by means of the uncoupling of the main carriages and the tensioning device (4) and to develop a buffer effect.

With this above-described basic design, the crosslapper (1) may be designed in different ways, e.g., corresponding to EP 1 828 453 B1, or to DE 203 21 834 U1 or to EP 0 517 563 B2. The difference to the prior-art crosslappers lies mainly in the design of the upper carriage (2) and the belt deflection device (12).

Figure 2:
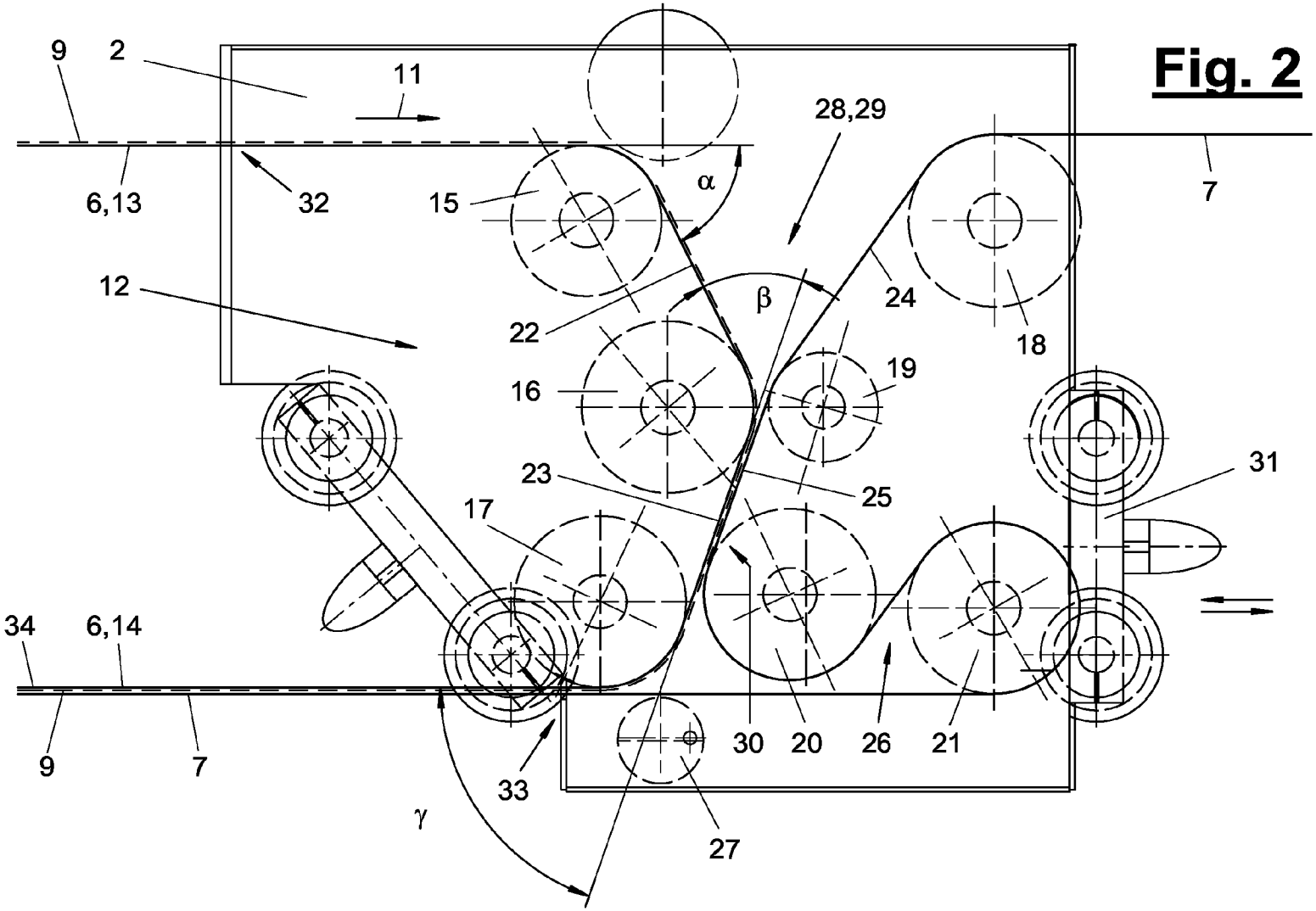
FIG. 2 is an enlarged and broken-off detail view of the upper carriage and of the belt deflection device.

FIG. 2 shows this belt deflection device (12) in an enlarged detail view. The two laying belts (6, 7) are separated from one another on the upper side at an inlet point (32) with the upper carriage (2) and the belt deflection device (12) and fed from opposite directions. The one laying belt (6) forms the so-called feeding belt, which takes up the fibrous web (9) on the input side (35), on the left in FIG. 1, of the crosslapper (1), carries it and feeds it to the upper carriage (2). The web guide may be on one side and in an open position, whereby possibly one or more pressing rollers are present.

The other laying belt (7) is designated as a counterbelt below. Both laying belts (6, 7) are fed in an essentially horizontal orientation to the upper carriage (2) and the belt deflection device (12). The feeding belt (6) is deflected at the belt deflection device (12) from its direction of feed (11) into the opposite direction by about 180° downwards to an outlet point (33) on the upper carriage. Both laying belts (6, 7) here emerge in a closely adjacent parallel position and, sandwiched with the fibrous web (9), form a web guide area (34) on both sides.

In the variant shown, the upper run (13) and the lower run (14) of the feeding belt (6) are aligned in parallel, whereby the discharge height of the upper carriage (2) and the intake height of the laying carriage (3) are identical. This results in a deflection angle of 180°. When the said discharge height and intake height are different, the lower run (14) may have a slope toward the horizontal, such that the deflection angle may deviate slightly from 180°. An angular deviation may also occur for other reasons, e.g., when the upper run (13) has an oblique position.

The counterbelt (7) is also deflected at the belt deflection device, whereby the direction of inlet and outlet of the counterbelt (7) at the upper carriage (2) may be equidirectional and may especially be horizontal. A vertical offset of the counterbelt (7) between inlet point and outlet point (32, 33) is brought about between them with the belt deflection device (12).

Both laying belts (6, 7) entering at the top are deflected downwards at the belt deflection device (12) and emerge again at the upper carriage (2) in a deeper position, which in the above-mentioned manner preferably has the same height as the intake point at the laying carriage (3).

As FIG. 2 illustrates, the belt deflection device (12) has three preferably rounded deflection points (15, 16, 17) for the so-called web-guiding laying belt (6) carrying the fibrous web (9). The number of deflection points may, as an alternative, also be greater and, e.g., be four. The deflection points (15, 16, 17) are, e.g., each formed by freely rotatable or possibly driven cylindrical deflection rollers, over whose jacket the feeding belt (6) is guided. As an alternative, other deflecting means are possible. A device conveying a holding action for the fibrous web (9), which generates, e.g., a holding or adhesive action by suctioning or blowing air, by electrostatic forces or the like, may also be present at the deflection points (15, 16, 17), especially at the rotatable deflection rollers.

The three deflection points (15, 16, 17) or deflection rollers are arranged at a distance above one another, whereby the middle deflection point (16) lies in the direction of feed (11) farther forward than the other two deflection points (15, 17). As a result of this, a first straight belt section (22) is formed between the upper and the middle deflection point or deflection roller (15, 16) and a second straight belt section (23) of the feeding belt (6) is formed between the middle (16) and lower deflection point or deflection roller (17). The first belt section (22) in the direction of feed (11) is directed diagonally downward in the direction of feed (11). The second belt section (23) is directed diagonally downward against the direction of feed (11). In case the belt deflection device (12) has more than three deflection points for the feeding belt (6), the belt section (23) is the last belt section before the outlet point (33) of the upper carriage (2).

At each of the three deflection points (15, 16, 17) shown, the feeding belt (6) has a deflection angle a, b, g, which is less than 90°. In total, the angles a, b, g produce the total deflection angle of, e.g., 180°.

In the exemplary embodiment shown, both the first deflection angle a at the first deflection point or deflection roller (15) and also the last, especially third deflection angle g at the last or third deflection point (17) is greater than the deflection angle g at the middle deflection point (16). The first deflection angle a may be between 55° and 70°, and preferably about 63°. The second smaller deflection angle b may be between 40° and 55°, and preferably about 46°. The third and, e.g., last deflection angle g may lie between 65° and 75° and is preferably about 71°.

The above-mentioned deflection angles a, b, g may vary in size and association. For example, in another embodiment, the first deflection point or deflection roller (15) at the upper carriage (2) may be shifted horizontally against the direction of feed (11), whereby the other two deflection points or deflection rollers (16, 17) maintain their arrangement and formation. As a result of this, the first deflection angle a is smaller and the second deflection angle b is greater than in FIG. 2, whereby their size ratio is also possibly changed, especially reversed.

The belt deflection device (12) likewise has three or more deflection rollers (18 to 21) for the other counterbelt (7). Hereby, three deflection rollers (18, 19, 20) are arranged at a distance above one another. Viewed in the direction of running of the counterbelt (7) to the upper carriage (2), the first deflection roller (18) lies in front of the middle deflection roller (19) and this middle deflection roller (19) in turn lies in front of the lower deflection roller (20). A first straight belt section (24) is formed between the first and second or middle deflection roller (18, 19) and a second straight belt section (25) is formed between the second or middle deflection roller (19) and the lower and/or third deflection roller (20). These straight belt sections (24, 25) also have different orientations.

In addition, another fourth deflection roller (21) is provided for the counterbelt (7) next to the lower deflection roller (20), with which the counterbelt (7) is deflected by more than 180° and then, at the outlet (33) of the upper carriage (2), assumes a parallel and, e.g., horizontal position to the feeding belt (6) and its lower run (14). A supporting roller (27) arranged below the deflection rollers (17, 20) supports the deflected counterbelt (7). It [supporting roller] may be adjustable to adjust the belt height and the distance to the feeding belt (6) and possibly to adapt to different web thicknesses.

At the outlet (33) of the upper carriage (2), the counterbelt (7) is arranged at the bottom and carries the fibrous web (9), whereby the feeding belt (6) is arranged above it and covers the fibrous web (9) from above.

According to FIG. 2, the fibrous web (9) is fed to the upper carriage (2) and to the belt deflection device (12) lying on the upper run (13) of the feeding belt (6) at the inlet point (32) lying at the top. In the subsequent straight belt section (22), which is directed diagonally downward, the fibrous web (9) is also guided lying on the feeding belt (6) on one side. The opposite first straight belt section (24) of the counterbelt (7) is spaced far away. The first straight belt sections (22, 24) of both laying belts (6, 7) have different orientations and run diagonally to one another.

The second or last straight belt sections (23, 25) of both laying belts (6, 7) run closely adjacent and are essentially equidirectional, whereby their orientation has a directional component against the direction of feed (11). The second or last straight belt sections (23, 25) form between them a narrow gap, in which the fibrous web (9) is received and is possibly guided on both sides with clamping connection. The said belt sections (23, 25) may run parallel to one another. For the purpose of a web compacting, they may also run with an acute angle conically to one another and consequently form a gap narrowing in the web running direction. The shape and size of the gap may be adjusted and changed.

As FIG. 2 illustrates, the deflection points or the jacket areas of the deflection rollers (16, 19) of the laying belts (6, 7) in question may have a different height, whereby, e.g., the deflection point of the counterbelt (7) is somewhat higher. To this end, the deflection rollers (16, 19) may be arranged with their axes at the same height, whereby the roller diameter of the deflection roller (16) is greater than that of the deflection roller (19). At the apex of the deflection point or deflection roller (16), at which the feeding belt (6) coming from the belt section (22) changes its direction and changes over into the belt section (23) which is sloped in the opposite direction, the straight belt section (25) of the counterbelt (7) already lies opposite the fibrous web (9). On the other hand, the straight belt section (25) of the counterbelt (7) ends in front of the straight belt section (23) of the feeding belt (6). The lower deflection rollers (17, 20) may be about the same size in diameter, whereby the deflection roller (20) of the counterbelt (7) is arranged with its axis somewhat above the axis of the deflection roller (17). The deflection rollers (17 through 21) of both laying belts (6, 7) may have adjustable axes and can be adapted to different web thicknesses or other web properties.

According to FIG. 2, the upper carriage (2) on the belt deflection device (12) has a web guide (28) with a plurality of, e.g., two guiding sections (29, 30), in which the fibrous web (9) is first guided on one side and then on both sides. A first open guiding section (29) is formed here between the first straight belt sections (22, 24) of the laying belts (6, 7), which run in a funnel-like manner diagonally to one another with a large opening angle of, e.g., more than 10°. The fibrous web (9) is guided on one side here on the feeding belt (6). Due to the moderate deflection angle a, the fibrous web (9), which is guided open, does not lift up from the feeding belt (6) even at high running speeds. In the exemplary embodiment shown, the second closed guiding section (30), into which the fibrous web (9) dips without guidance over a likewise moderate deflection angle b, is connected to the first open guiding section (29).

The second guiding section (30) forms a clamping section between the second straight belt sections (23, 25), between which the fibrous web (9) is guided on both sides in clamping connection. The clamping area (30) is directed toward the outlet point (33) and ends shortly in front of it. At the end of the clamping area (30), the guiding on both sides is lifted again, whereby the possibly compacted and additionally stabilized fibrous web (9) is deflected moderately by angle g at the third deflection point (17) again with guiding on one side on the feeding belt (6) and then enters the guiding area (34) on both sides on the outlet side (33) between the laying belts (6, 7) guided together again. Due to the oblique position of the clamping area (30) and the straight belt sections (23, 25), the fibrous web (9) already has a directional component against the direction of feed (11) and in a continuing direction to the laying carriage (3). Thus, even at this deflection point (17), it does not detach from the carrying feeding belt (6) in spite of the guiding on one side. This is also the case at high running speeds and correspondingly high centrifugal forces.

One or more plant components may be arranged upstream of the crosslapper (1) on the input side (35). This may be, e.g., a web-forming device, especially a carder. Moreover, a stretching device or compression device, a web storage unit or similar plant components may be arranged upstream. The said plant components are not shown for the sake of clarity.

On the discharge side of the crosslapper (1) and the discharge point of the pull-off device (8), one or more plant components may also be arranged downstream. This may be a nonwoven-strengthening device, e.g., a one-step or multistep needle machine, a water-jet strengthening unit, a thermal strengthening device or the like. Likewise, a compensating belt may also be inserted between the crosslapper (1) and the strengthening device, and in particular a needle machine, for buffering and compensating fluctuating nonwoven discharge speeds. These downstream plant components are also not shown for the sake of clarity.

A variety of variants of the embodiments shown and described are possible. The number of the deflection points (15, 16, 17) of the feeding belt (6) may be greater than three and may be, e.g., four or five, whereby the number and orientation of the straight belt sections (22, 23) increase correspondingly. The size and distribution of the deflection angles may also change thereby. The deflection points (18, 19, 20) of the counterbelt (7) may be correspondingly adapted. The web guide (28) in this case may also have a greater number of sections, whereby the number of open guiding sections (29) and/or clamping sections (30) may be increased.

The crosslapper (1) can be designed, e.g., as a synchronous crosslapper, in which the main carriages (2, 3) are moved in opposite directions and which are guided via a deflection device fixed to the frame, e.g., a deflection roller in the guiding area (34) of parallel running laying belts (6, 7) between the two main carriages (2, 3). Further, the tensioning device (4) may be omitted or may be designed differently, whereby it has, e.g., only a single auxiliary and tensioning carriage. Further, the guiding of the laying belts (6, 7) may be designed differently, whereby, e.g., one or more additional support carriages are arranged. The counterbelt (7) may be displaced up to the input side of the crosslapper (1) for the formation of a closed web feed and cover the fibrous web (9) on the feeding belt (6). Such variations of the construction form of the crosslapper (1) shown may be designed, e.g., according to EP 1 010 785, EP 1 010 786 or EP 1 010 787.

In the exemplary embodiment shown, the laying belts (6, 7) consist of high-tensile and flexurally elastic plastic webs. As an alternative, they may consist of other materials and be designed, e.g., as chain or slat belts. Variations are also possible with regard to drive technique. The main carriages (2, 3) may have a common drive for their travel motions and may be mechanically coupled to one another by a cable or the like.

The crosslapper (1) has a preferably programmable control (not shown), to which the various drives of the main carriages (2, 3), of the laying belts (6, 7) and of the pull-off device (8) as well as of possibly other components, e.g., of a stretching device arranged in the intake area, are connected. This control may be connected in a subordinate plant control or integrated in same.

A belt deflection device (12) of the type shown with a plurality of deflection points for at least one laying belt (6, 7) may also be present at other points of a crosslapper (1), e.g., on the laying carriage (3) or on a stationary 180°-belt deflection device in the frame of the crosslapper (1).

While specific embodiments of the invention have been shown and described in detail to illustrate the application of the principles of the invention, it will be understood that the invention may be embodied otherwise without departing from such principles.

The invention claimed is:

1. A crosslapper comprising:

main carriages comprising: an upper carriage with deflection rollers and a laying carriage with deflection rollers;

two endless laying belts, which are each guided via the deflection rollers on the main carriages, whereby one of the laying belts comprises a feeding belt, which carries a fibrous web and feeds the fibrous web to the upper carriage, and the upper carriage has a belt deflection device with the deflection rollers for both laying belts, wherein:

the feeding belt is deflected at the belt deflection device from a feed direction into the opposite direction by about 180°, the belt deflection device comprises three or more deflection points for deflecting the feeding belt;

the deflection points are formed by deflection rollers at the belt deflection device;

an upper or first of belt section, of the feeding belt, in a direction of feed is directed diagonally downward in the feed direction;

a second or a last of the belt section, of the feeding belt, is directed diagonally downward opposite to the feed direction;

a counterbelt has two or more straight belt sections with different orientations at the belt deflection device;

the upper or first straight belt section of the feeding belt and an upper or first of the straight belt sections of the counterbelt have different orientations and run diagonally to one another; and the second or last straight belt section of the feeding belt and a second or last of the straight belt sections of the counterbelt are closely adjacent and run in essentially identical directions.

2. A crosslapper in accordance with claim 1, wherein the feeding belt at the belt deflection device has two or more straight belt sections with different orientations.

3. A crosslapper in accordance with claim 2, wherein the straight belt sections are arranged between the deflection rollers.

4. A crosslapper in accordance with claim 1, wherein the feeding belt has a deflection angle of less than 90° at each of the three or more deflection points.

5. A crosslapper in accordance with claim 4, wherein a first deflection angle and a third deflection angle are each greater than a second deflection angle.

6. A crosslapper in accordance with claim 5, wherein the first deflection angle is between 55° and 70°.

7. A crosslapper in accordance with claim 5, wherein the second deflection angle is between 40° and 55°.

8. A crosslapper in accordance with claim 5, wherein the third deflection angle is the last deflection angle and is between 65° and 75°.

9. A crosslapper in accordance with claim 1, wherein the other laying belt is a counterbelt and the belt deflection device for the counterbelt has three or more deflection rollers.

10. A crosslapper in accordance with claim 1, wherein second or last straight belt sections of both laying belts run parallel to one another or with an acute angle conically to one another.

11. A crosslapper in accordance with claim 1, wherein the upper carriage on the belt deflection device has a web guide with a plurality of sections, in which the fibrous web is guided first on one side and then on both sides.

12. A crosslapper in accordance with claim 3, wherein a first open guiding section is formed between the first straight belt sections, whereby the fibrous web is guided on one side at the one feeding belt.

13. A crosslapper in accordance with claim 3, wherein a following, closed guiding section is formed between the second or last straight belt sections of both laying belts, whereby the fibrous web is guided on both sides in clamping connection.

14. A crosslapper in accordance with claim 1, wherein the main carriages are arranged movable parallel to one another and are driven and controlled independently.

15. A crosslapper in accordance with claim 1, further comprising controlled belt drives for the rotary drive of the laying belts.

16. A crosslapper in accordance with claim 1, further comprising a tensioning device with an auxiliary carriage arrangement, for the laying belts, which is coupled with the main carriages.

17. A crosslapper in accordance with claim 1, wherein the laying belts are guided parallel in the area between the main carriages in a single straight section and clamp the fibrous web between them.

18. A crosslapper in accordance with claim 1, further comprising a controlled pull-off device comprising a discharge belt, for the laid multilayer nonwoven formed from the fibrous web.

19. A crosslapper in accordance with claim 1, wherein the crosslapper is arranged downstream of a web-forming a carder.

20. A crosslapper in accordance with claim 1, wherein the crosslapper is arranged upstream of a nonwoven strengthening device a needle machine.

21. A crosslapper in accordance with claim 1, wherein the deflection rollers of the belt deflection device comprise three or more deflection rollers for deflecting the counterbelt comprising three counterbelt deflection rollers arranged spaced a distance above one another and with respect to a direction of running of the counterbelt relative to the upper carriage, a first of the three counterbelt deflection rollers lies in front of a middle of the three counterbelt deflection rollers deflection roller and the middle of the three counterbelt deflection rollers lies in front of a lower deflection roller of the three counterbelt deflection rollers.

22. A crosslapper in accordance with claim 21, wherein the three or more deflection rollers for deflecting the counterbelt further comprises a fourth deflection roller for the counterbelt adjacent to the lower deflection roller, the fourth deflection roller deflecting the counterbelt by more than 180° whereby at an outlet of the upper carriage the counterbelt assumes a parallel and horizontal position relative to a lower run of the feeding belt.

23. A method in accordance with claim 22 wherein the three or more deflection rollers for deflecting the counterbelt further comprises a fourth deflection roller for the counterbelt adjacent to the lower deflection roller, the fourth deflection roller deflecting the counterbelt by more than 180° whereby at an outlet of the upper carriage the counterbelt assumes a parallel and horizontal position relative to a lower run of the feeding belt.

24. A method for laying of a multilayer nonwoven, the method comprising the steps of:

providing a crosslapper comprising main carriages comprising an upper carriage and a laying carriage and two endless laying belts, which are guided via deflection rollers on the main carriages, one of the laying belts comprising a feeding belt and carries a fibrous web and feeds the fibrous web to the upper carriage, and the upper carriage has a belt deflection device with the deflection rollers for both laying belts;

deflecting the feeding belt at the belt deflection device from a direction of feed into an opposite direction by about 180°; and deflecting the feeding belt at the belt deflection device at three or more deflection points, wherein:

the deflection points are formed by deflection rollers at the belt deflection device;

an upper or first of belt section, of the feeding belt, in a direction of feed is directed diagonally downward in the feed direction;

a second or a last of the belt section, of the feeding belt, is directed diagonally downward opposite to the feed direction;

a counterbelt has two or more straight belt sections with different orientations at the belt deflection device;

the upper or first straight belt section of the feeding belt and an upper or first of the straight belt sections of the counterbelt have different orientations and run diagonally to one another; and the second or last straight belt section of the feeding belt and a second or last of the straight belt sections of the counterbelt are closely adjacent and run in essentially identical directions.

25. A method in accordance with claim 24, wherein the deflection rollers of the belt deflection device comprise three or more deflection rollers for deflecting the counterbelt including three counterbelt deflection rollers arranged spaced a distance above one another and with respect to the direction of running of the counterbelt relative to the upper carriage, a first of the three counterbelt deflection rollers lies in front of a middle of the three counterbelt deflection rollers deflection roller and the middle of the three counterbelt deflection rollers lies in front of a lower deflection roller of the three counterbelt deflection rollers.

* * * * *